US006644576B1

(12) United States Patent
Hicklin

(10) Patent No.: US 6,644,576 B1
(45) Date of Patent: Nov. 11, 2003

(54) BLADE SWEEP FOR PULVERIZERS

(76) Inventor: Stuart W. Hicklin, 707 Colony Ct., Fort Collins, CO (US) 80526

( * ) Notice: Subject to any disclaimer, the term of this patent is extended or adjusted under 35 U.S.C. 154(b) by 0 days.

(21) Appl. No.: 10/158,610

(22) Filed: May 30, 2002

(51) Int. Cl.[7] ..... B02C 15/00
(52) U.S. Cl. ..... 241/119
(58) Field of Search ..... 241/117–124, 301

(56) References Cited

U.S. PATENT DOCUMENTS 5,480,099 A 1/1996 Bunton 5,904,307 A 5/1999 Prairie et al.

*Primary Examiner*—Mark Rosenbaum
(74) *Attorney, Agent, or Firm*—Ancel W. Lewis, Jr.

(57) ABSTRACT

A blade sweep for a pulverizer having a grinding bowl to which the sweep is attached and a floor with a discharged outlet over which the sweep is moved. One blade sweep disclosed is mounted to the bowl skirt and another blade sweep disclosed is mounted to the underside of the bowl. The blade sweep includes a blade, a mounting base, and an axle extending along the mounting base. The axle is substantially horizontal and is rotatable about a longitudinal axis of the axle and pivot brackets are rigidly attached to the axle to allow the blade to swing up to a raised position to clear reject material. A biasing device urges the blade to return to the down sweeping position.

32 Claims, 9 Drawing Sheets

BLADE SWEEP FOR PULVERIZERS

TECHNICAL FIELD

This invention relates to pulverizers and more particularly to a novel and improved blade sweep for use in vertical spindle pulverizers.

BACKGROUND ART

In conventional vertical spindle pulverizers, a material to be pulverized, such as raw coal is distributed onto a rotating grinding bowl to be ground into fine, powder-like particles by a number of stationary rollers. These pulverizers are commonly known as roll-and-race or ball-and-track pulverizers. Pulverizers pare materials down to a fine particle size via crushing pressure, impact and attrition. After fluidization, the particles are suspended and then transported through an outlet and then through discharge pipes to be combusted (e.g. in a power plant boiler) by air that has been forced upwardly around the circumference of the bowl.

Because of the nature of mining, many ungrindable objects (e.g. rocks, shale, iron pyrites, tramp iron, etc.) and herein referred to as reject material, are included in the material to be ground. These objects, which are too heavy to be pneumatically transported through the pulverizer outlet, are rejected by the system and pushed over the edge of the bowl and land underneath in an under-bowl area above the floor. To inhibit excessive accumulation, potential fires and/or explosions, this rejected material must be constantly discharged from the under-bowl area. Presently known sweeps used for removal of such reject material are connected to and rotate with the bowl hub or skirt near the floor. This apparatus, commonly referred to as a plow or scraper, is generally very heavy, difficult to maintain and expensive. In most cases, a vertical pivot wears allowing the assembly to make contact with the floor, or a coaxial spring arrangement fails, causing floor damage and the potential for igniting under-bowl fires.

A brush sweep described in U.S. Pat. No. 5,480,099, assigned to the assignee of the present application, utilizes a plurality of cables. This provides a sweep that is significantly lighter, easier to maintain and relatively inexpensive as compared to previously known sweeps. The plow, scraper, and brush sweep rotate in a horizontal plane to clear the reject material from the floor and push the reject material down an outlet in the floor to be collected in a hopper and be discarded.

Prairie et al. U.S. Pat. No. 5,904,307 discloses a scraper for a pulverizer, including a bracket attached to a rotating spindle hub, a shaft supported at one end only and extending radially out from the bracket and rotating about the vertical axis with the spindle. A scraper element is pivotally mounted to rotate about the axis of the shaft and a torsion spring is used to bias the shaft to a scraping position.

DISCLOSURE OF THE INVENTION

A blade sweep for a pulverizer is disclosed. In the first embodiment disclosed the blade sweep is secured to the spindle skirt. This blade sweep includes a mounting base mounted to rotate with the spindle skirt about a vertical axis, an axle extending parallel to and supported for rotation about the longitudinal axis of the spindle at more than one point along the axle by the mounting base. A plurality of pivot brackets are disposed at axially spaced positions along the axle and are rigidly affixed to the axle, preferably by welding, to rotate with the axle, a sweep blade extends along and is located below the axle and the mounting bar and is affixed to the axle to rotate with the axle. A bias assembly resists upward blade movement with the axle and returns the blade to a vertical sweeping position. The blade is easily adjusted vertically end to end and may be easily replaced as required. In the second embodiment the blade sweep is secured to the underside of the bowl.

BRIEF DESCRIPTION OF THE DRAWINGS

Details of this invention are described in connection with the accompanying drawings that bear similar reference numerals in which.

DETAILED DESCRIPTION

Figure 1:
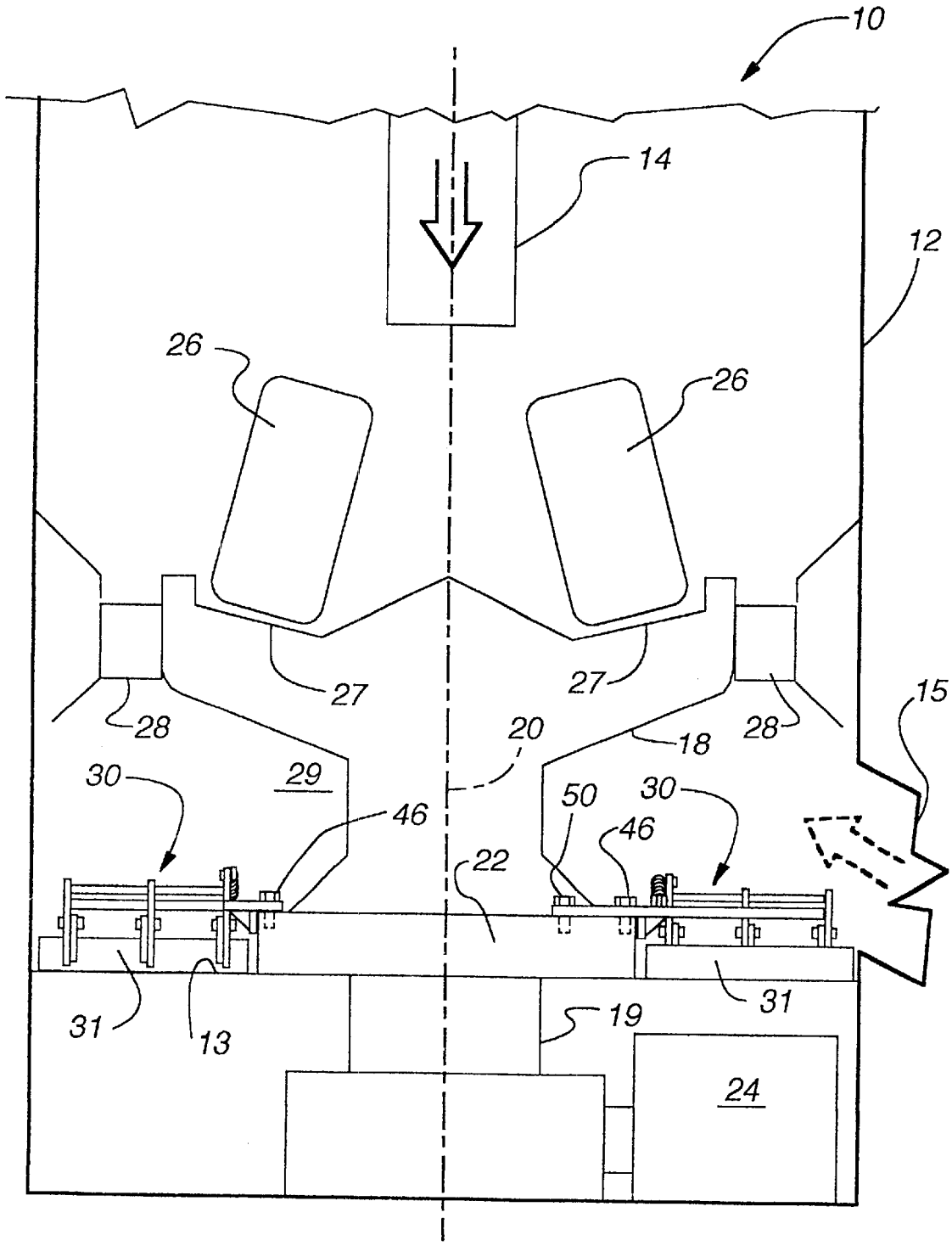
FIG. 1 is a partially schematic vertical elevational view of a pulverizer with a first embodiment of a blade sweep mounted to the spindle skirt embodying features of the present invention.
Figure 2:
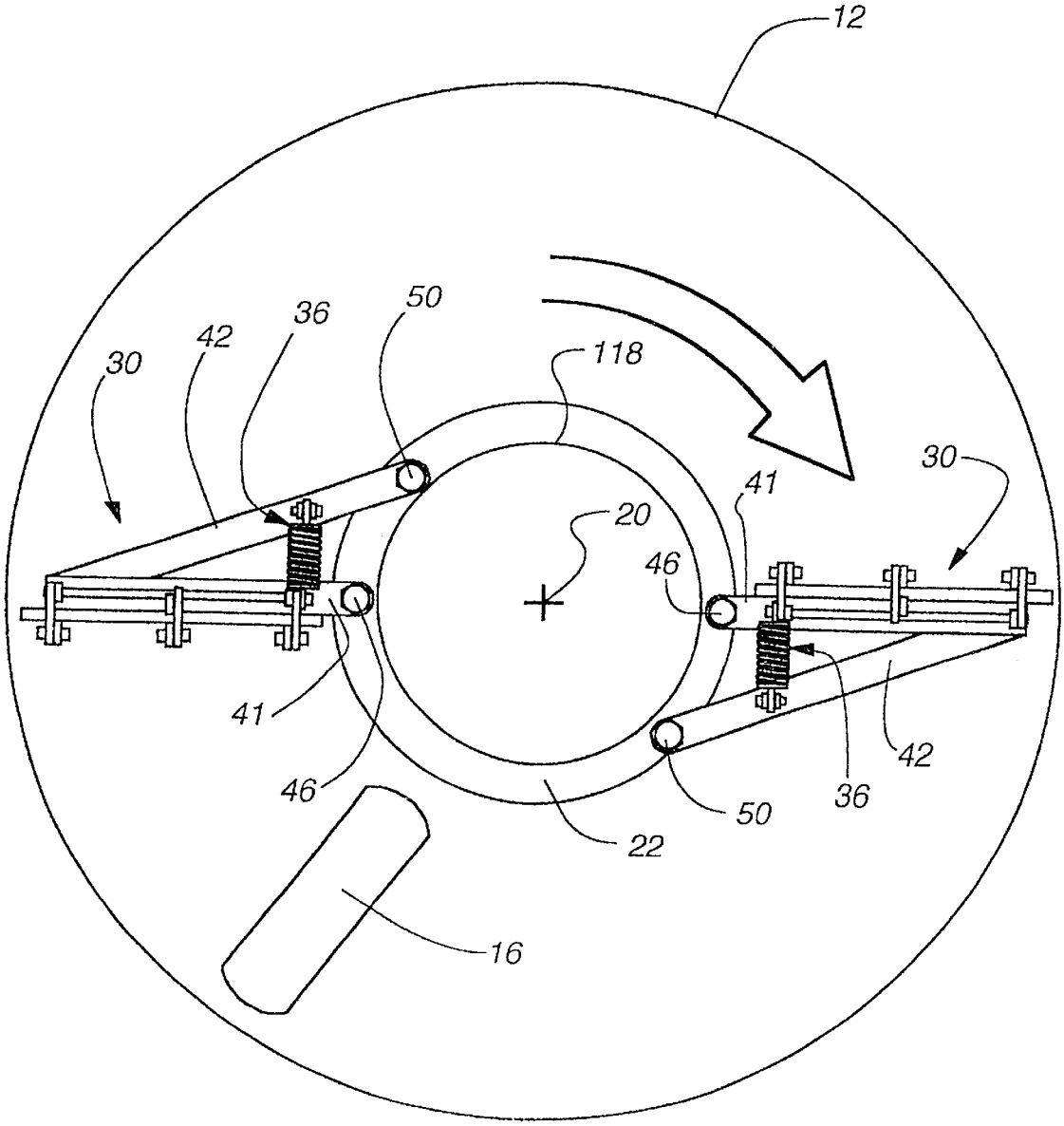
FIG. 2 is a partially schematic top plan view of the pulverizer and blade sweep shown in FIG. 1.
Figure 3:
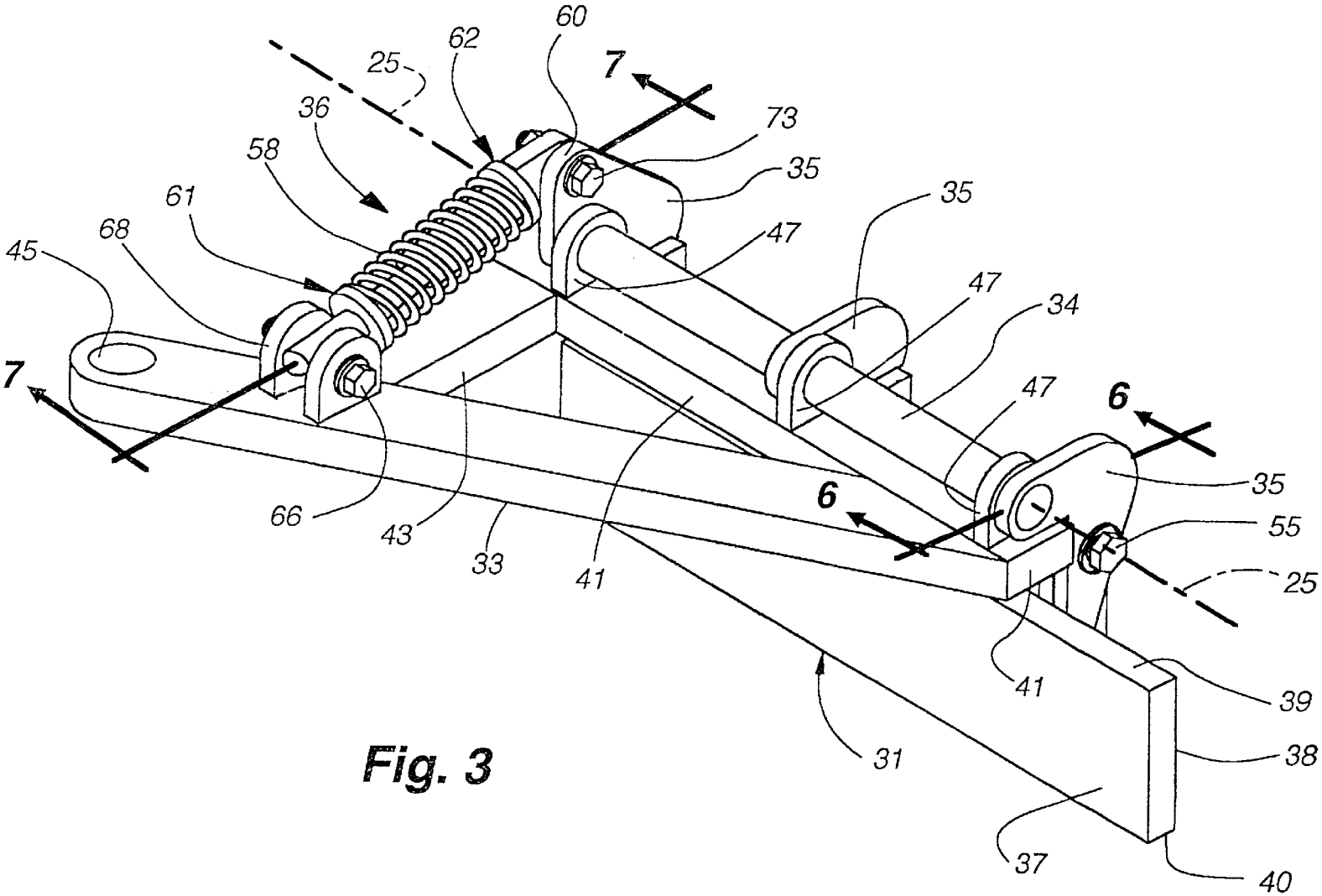
FIG. 3 is a front perspective view of the blade sweep shown in FIG. 1 taken below the bowl.
Figure 4:
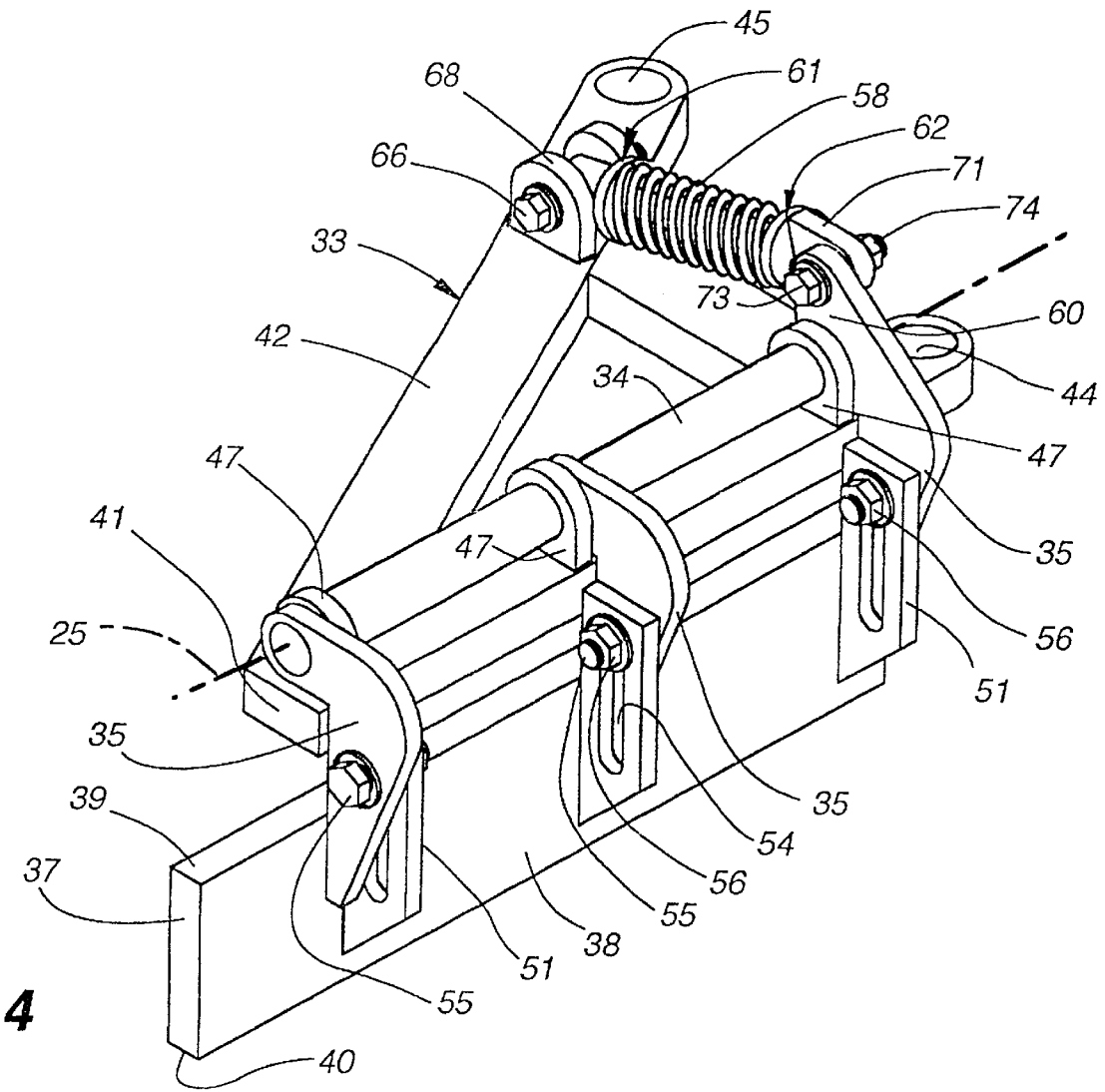
FIG. 4 is a rear perspective view of the blade sweep shown in FIG. 3.

Referring now to FIGS. 1 and 2 there is shown a pulverizer 10 having a vertically oriented cylindrical housing 12 and a floor 13 in the bottom of the housing. A feed chute 14 is mounted in the top of the housing, an air inlet 15 in a lower part of the housing, and a reject material outlet 16 is provided in the floor 13. A rotary grinding bowl 18 is disposed in the housing on a vertical rotary spindle 19 extending up through the floor 13, and the bowl 18 and spindle 19 rotate together about a vertical axis 20. A skirt 22 encircles the spindle and rotates with the bowl and spindle about vertical axis 20. A motor 24 is coupled to the spindle to rotate the spindle 19, bowl and skirt 22 about the vertical axis 20. Grinding rollers 26 are mounted in a race 27 the top of the grinding bowl 18.

In operation, a raw material to be ground, such as coal, is distributed onto the bowl 12 by the chute 14 and is pulverized on the grinding bowl 18 by means of pressure and attrition from the rollers 26 in the race 27. An airstream enters through the air inlet 15 and passes through vanes 28 on the outer circumference of the bowl 18. This air transports the finely ground powder-like material produced by the pulverizer via a pipe, to a power plant boiler and the like. The ungrindable reject material such as pyrites, rocks, etc. are pushed over the edge of the bowl and fall through the under-bowl area 29 and onto the floor 13.

The blade sweep 30 includes a blade 31 and a blade mounting assembly [32] for supporting the blade vertically above the floor in the normal sweep position and also for supporting the blade for rotation away from the direction of movement about a horizontal axis above the blade to a raised position to clear reject material as required. The blade 31 is shown mounted to the skirt 22 and extends radially out from the skirt to terminate near the inside of the housing 12. The blade mounting assembly [32] includes a mounting base 33, an axle 34, a plurality of pivot bracket 35, and a blade biasing device 36.

The blade 31 is generally rectangular shaped with a rectangular cross section. The blade as a flat leading front face 37, a flat trailing rear face 38, a flat top edge 39 and a flat bottom edge 40.

The mounting base 33 is in the form of an A-frame and includes a mounting bar 41 that extends substantially radially out from the spindle skirt and an inclined support bar 42 connected at one end to the mounting bar and extending at an acute angle to the mounting bar, together with a cross bar 43 extending transverse and connected at opposite ends to the mounting bar and support bar. Mounting bar 41 has an aperture 44 and support bar 42 has an aperture 45 in end portions opposite the connection ends. Aperture 44 receives a threaded bolt 46 and aperture 45 receives a threaded bolt 50 to fasten the mounting base 33 to the spindle skirt 22.

The axle 34 is mounted for rotation about a horizontal longitudinal axis 25 of the axle above the mounting base 33 and specifically mounting bar 41, and is shown supported in three spaced journals 47 rigidly mounted to the bar 41 as by welding. The three journals 47 shown has one adjacent to each end and the other midway between the ends of the axle 34.

Each pivot bracket 35 has a top leg 48 extending rearwardly from the axle and a vertical leg 49 extending down from the rear of the top leg 48. The bottom edge 48*a* of the top leg 48 is opposite the top surface of the mounting bar 41 and the front edge 49*a* of the vertical leg 49 engages a rear surface of the mounting bar 41 to limit the extent of forward rotation of the axle 34 and pivot brackets 35. The vertical leg 49 is made in two parts and is length adjustable to enable the blade to be vertically adjustable and to be readily detached from the axle. The vertical leg 49 has an upper section 51 integral with the top leg 48 and a lower section 52 that is a separate part and is movable relative to the upper section 51 to change the length of the vertical leg 49. To this end the upper section 51 has a hole and the lower section 52 has a vertical slot 54. A threaded bolt 55 extends through the hole in upper section 51 and slot 54 and a nut 56 threads on the bolt 55. A tightening of the nut 56 rigidly affixes the lower section 52 to the upper section 51.

The front edge of the lower section 52 engages the rear face 38 of the blade and is affixed thereto as by welding with the lower section 52 extending substantially above the top edge 39 of the blade. The upper section 51 is held in a vertical position so slot 54 remains vertical when the blade is in the down operating position. The upper section 51 is laterally outside the lower section 52 and the lower section 52 will slide up and down along the upper section and the bolt 55 and nut 56 hold the two sections together. When the nut 56 is loosened the lower section 52 and blade 31 is enabled to slide up and down with the upper section held vertical and the movement of the lower section 52 and blade 31 is vertical. This establishes guided vertical up and down movement of the blade 31.

In the normal operating down sweep position the upper section 51 remains vertical as the lower section 52 and blade 31 will slide upwardly and down vertically when the nut 56 is loosened as to adjust the height of the blade relative to the floor and also to adjust the tilt of the blade.

Figure 5A:
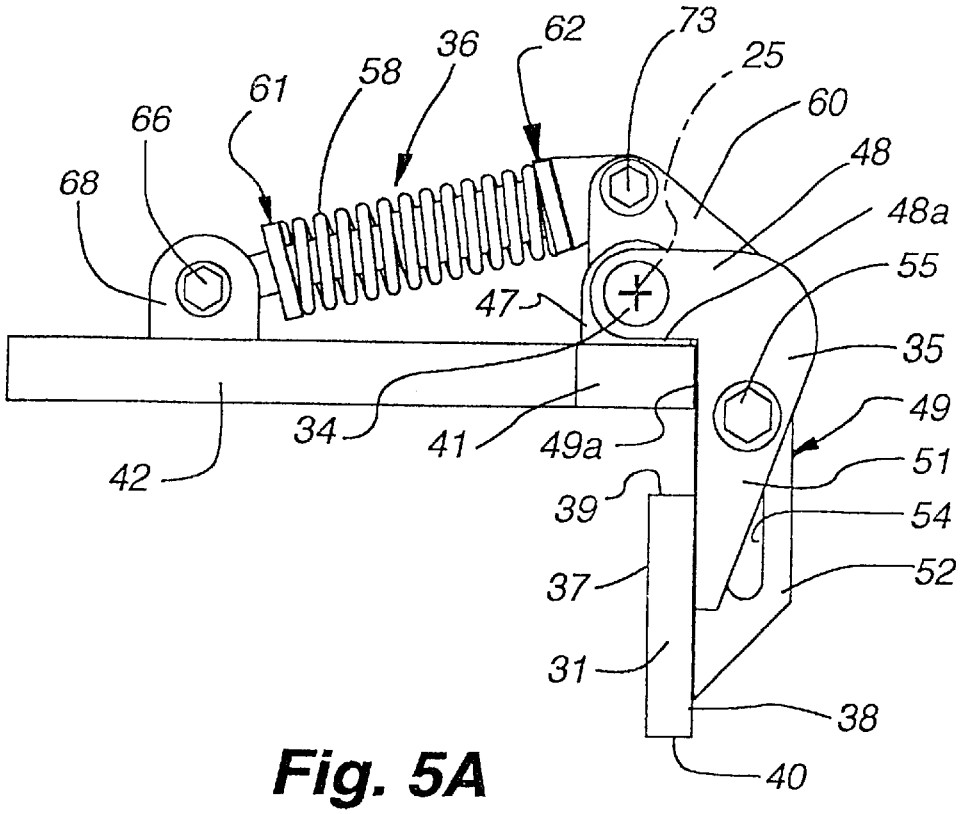
FIG. 5A is an end elevation view of the blade sweep shown in FIG. 4.
Figure 5B:
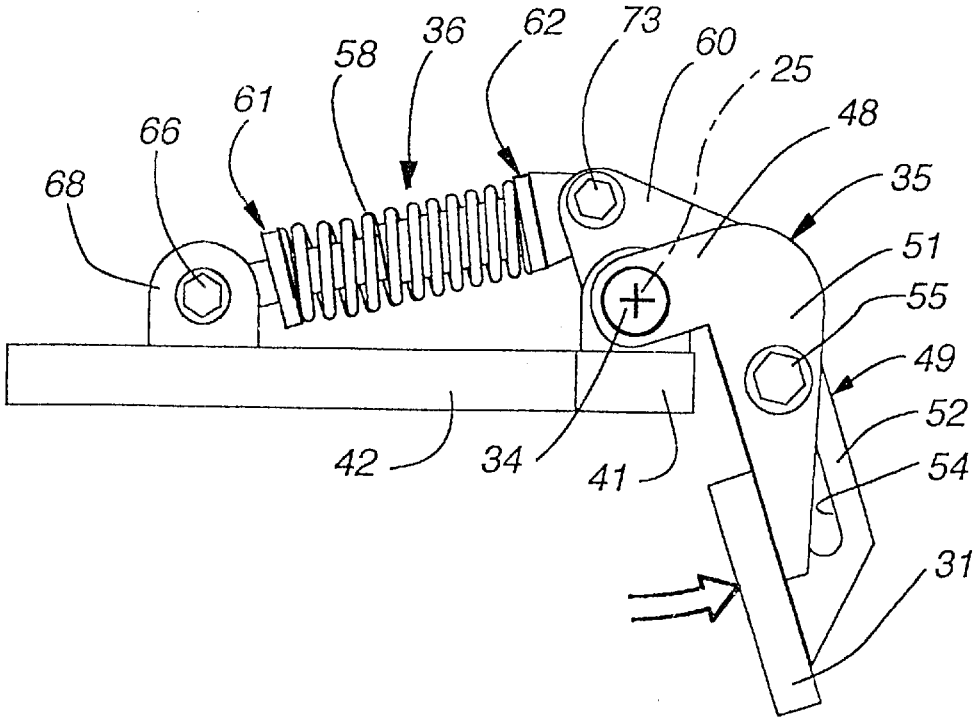
FIG. 5B is an end elevation view of the blade sweep in a raised position.
Figure 6:
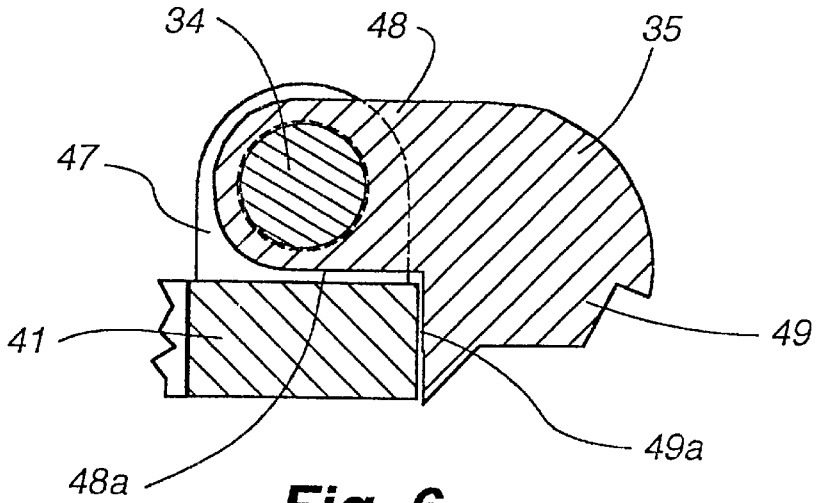
FIG. 6 is a sectional view taken along line 6—6 of FIG. 3.
Figure 7:
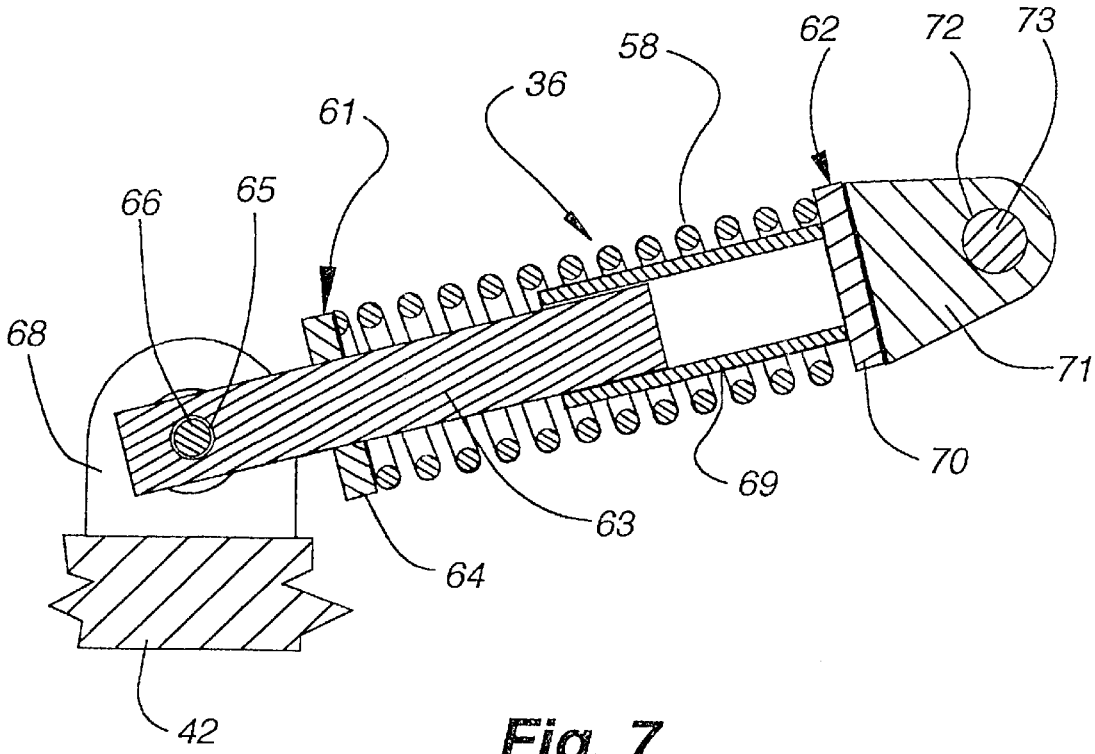
FIG. 7 is a sectional view taken along line 7—7 of FIG. 3.

As forces are applied to the leading front face 37 of the blade, as a result of striking the reject material, the blade will pivot about the longitudinal axis 25 of the axle 34 to which the blade is rigidly affixed as is shown in FIG. 5B.

The blade biasing device 36 is provided by a compression spring 58 held between opposed spring brackets 61 and 62 that are arranged to move relative to one another along the axis of the spring 58. The spring 58 is substantially perpendicular to the axle 34. Spring bracket 61 has a rod 63 with a washer 64 affixed thereto that bears against one end of the spring 58. The rod has a hole 65 through which a threaded bolt 66 extends with a nut 67 threaded thereon. The bolt 66 extends through a pair of spaced clevis tabs 68 attached to the top of the support bar 42 as by welding to rigidly fasten the spring bracket 61 to the support bar 42. The other support bracket 62 has a tubular body 69 that telescopes over the rod 63 and has a washer 70 affixed thereto that bears against the other end of the spring 58. A tab 71 with a hole 72 is mounted on the outer end of the washer through which a threaded bolt 73 extends with a nut 74 threaded thereon to fasten the device 36 to a bell and crank portion 60 on the top of the innermost pivot bracket 35. When the blade rotates along the axis 25 the axle as shown in FIG. 5B the spring 58 is compressed and the spring pressure will tend to return the blade to the down position. Rotation of the axle 34 then is translated through a bell crank portion 60 into compression spring 58. The compression spring 58 supplies resistance thought the axle 34 and pivot brackets 35 to any deflection of the sweep blade caused by striking the rejected material. Additional compression springs and bell cranks may be affixed in parallel to increase the amount of pivot resistence.

By way of illustration not limitation, the length of the blade may be varied from approximately six to twenty-four inches. The preferred thickness of the blade is about 0.75 inches, but may range from 0.5 to 1 inch. The height of each blade is preferable 3 inches, although the height of the blades could vary from 2 to 6 inches as necessary.

From the foregoing, it is clear that the above described construction furnishes a sweep blade which is lightweight, yet sufficiently durable to convey reject materials from the floor of the pulverizer into and through an outlet in the floor. The length of the sweep blade will determine the spacing and number of pivot brackets. For example, a 20 inch sweep blade may have 3 pivot brackets, while a 12 inch sweep blade may have 2 brackets.

Figure 8:
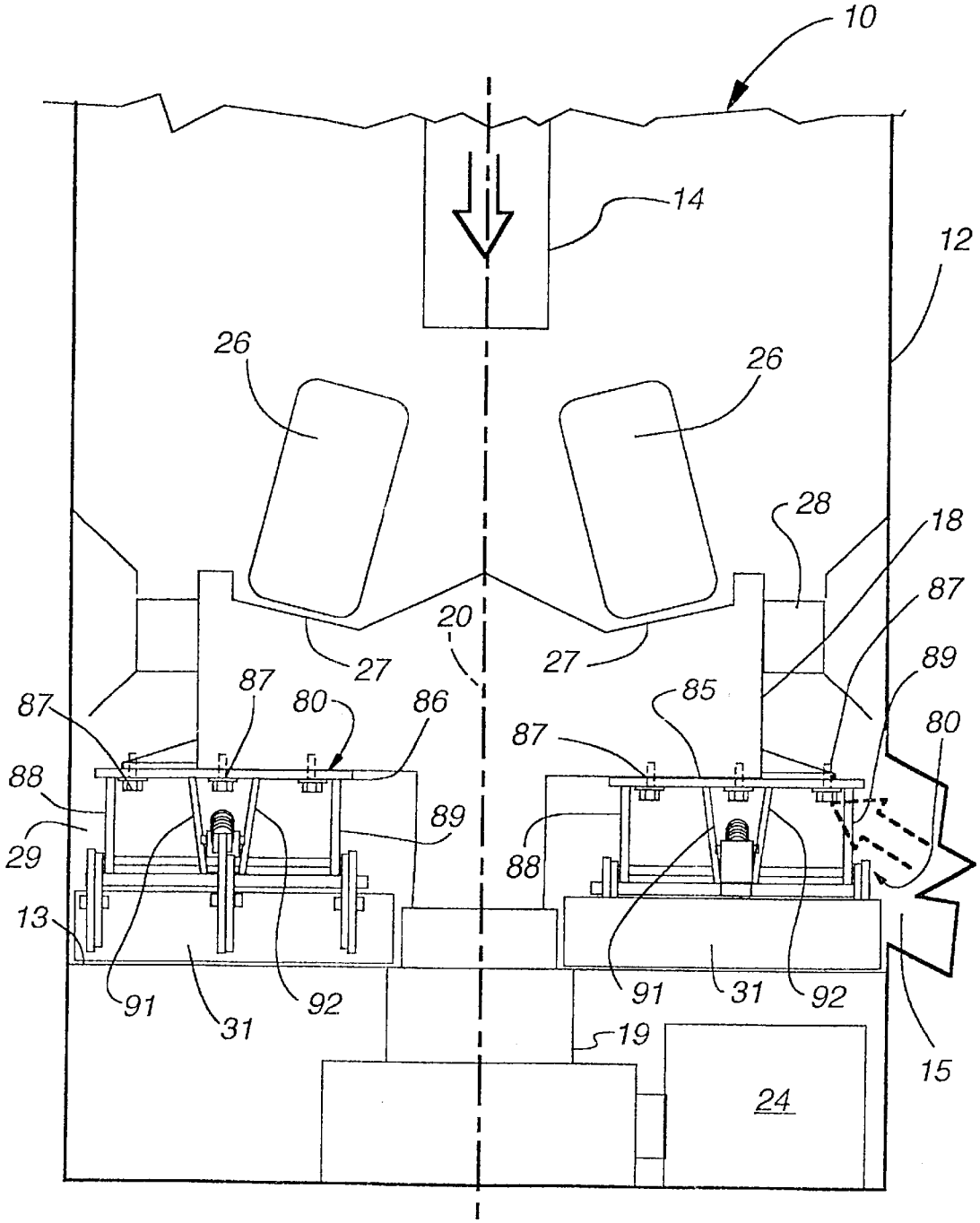
FIG. 8 is a partially schematic elevational view of a pulverizer with a second embodiment of a blade sweep mounted to the underside of the bowl.
Figure 9:
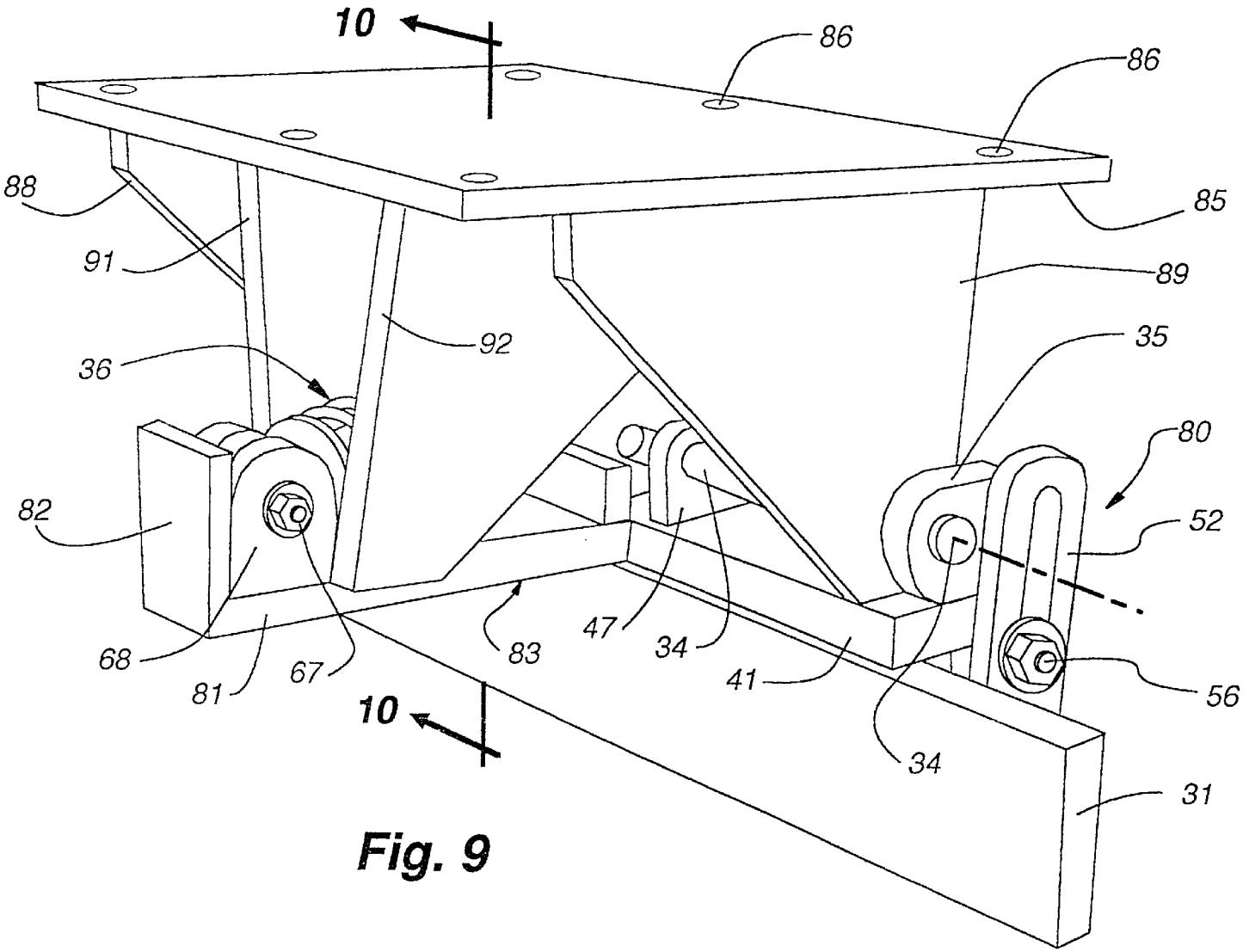
FIG. 9 is a front respective view of the blade sweep shown in FIG. 8.
Figure 10:
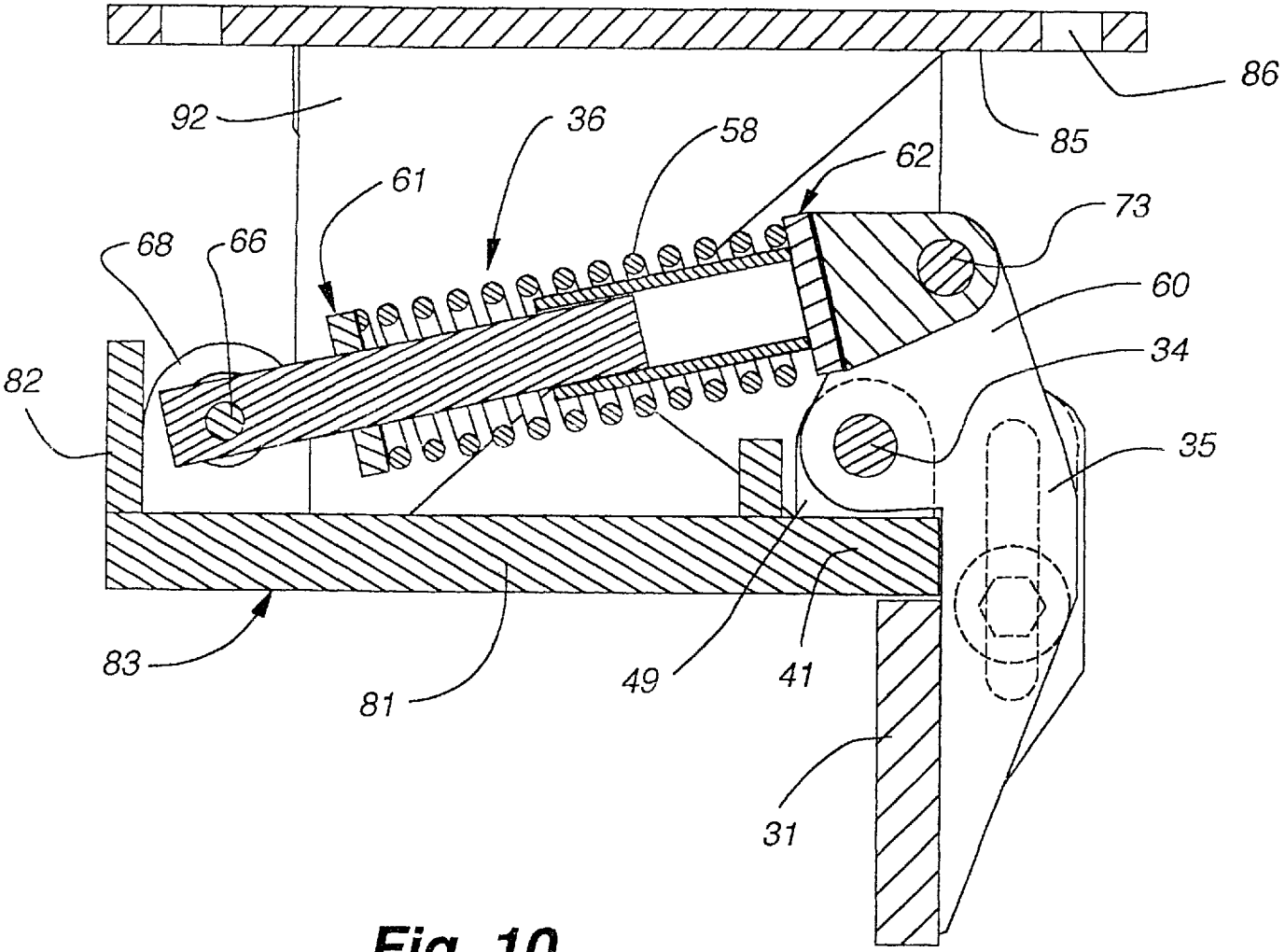
FIG. 10 is a sectional view taken along line 10—10 of FIG. 9.

Referring now to FIGS. 8–10 there is shown an alternative embodiment of the blade sweep 80 adapted to mount on the underside of the grinding bowl 18 to rotate with the bowl 18. This embodiment has a mounting base 83 in the form of a T-frame and includes a mounting bar 41 that extends radially out from the spindle as above described and a transverse support bar 81 connected at one end to a central area of mounting bar 41 and extends perpendicular thereto with an upright support base 82 at the outer end.

The mounting base 83 is supported from above by a top mounting plate 85 with six holes 86 having bolts 87 that extend into the bottom of the bowl. Two outer parallel spaced, support plates 88 and 89 extend down from the underside of the mounting plate 85 and connect to the ends of the mounting bar 41 as by welding. Two inside, spaced support plates 91 and 92 extend down from the underside of the top plate and are secured to the support bar 81 as by welding.

The axle 34 is supported for rotation between the ends by a journal 47 affixed to the mounting base 41 and in holes in outer support plates 88 and 89 which serve as journals at both ends of the axle. The pivot brackets 35 affixed to axle 34, the blade biasing device 36 and blade 31 are the same as those described in the embodiment shown in FIGS. 1–7.

Although the present invention has been described with a certain degree of particularity, it is understood that the present disclosure has been made by way of example and that changes in details of structure may be made without departing from the spirit thereof.

What is claimed is:

1. A blade sweep and pulverizer comprising:

a pulverizer including a housing with a floor, a rotary grinding bowl in the housing above the floor, a rotary spindle in the housing for rotating with the grinding bowl about a vertical axis, said blade sweep including, a blade, blade mounting means for supporting said blade vertically above said floor in a down position for sweeping and also for supporting said blade for rotation rearward about a substantially horizontal axis above said blade to a raised position to clear reject material on said floor, said blade mounting means including a mounting base adapted to mount to rotate with said spindle about said vertical axis and adapted to extend radially out from said bowl to near an inside wall surface of said housing, an axle extending along and in substantially parallel relation to said mounting base, said axle supported by said mounting base for rotation about a longitudinal axis of said axle and rotate relative to said mounting base, pivot bracket means along said axle, said pivot bracket means being rigidly fastened to said axle to rotate said axle, and blade biasing means supported by said mounting base arranged to urge said blade to said down position and resist movement to said raised position when said blade is impacted by said reject material during the rotation of said blade over said floor about said vertical axis.

2. The sweep and pulverizer as defined in claim 1 wherein said mounting base is in the form of an A-frame and includes a mounting bar extending substantially radially out from said spindle, a support bar connected at one end to an end of said mounting bar and extending at an acute angle to said mounting bar, and a cross bar extending transverse to and connected at opposite ends to said mounting bar and said support bar.

3. The sweep and pulverizer as defined in claim 2 wherein said mounting bar and said support bar each have an aperture in an end portion opposite said connected ends to receive a bolt to attach said mounting base to rotate with said spindle, said axle being supported for rotation along and in substantially parallel relation to said mounting base.

4. The sweep and pulverizer as defined in claim 1 wherein said mounting base is in the form of a T-frame and includes a mounting base extending substantially radially out from said spindle, and a transverse support bar connected at one end to an intermediate portion of said mounting base and extending substantially perpendicular to said mounting base.

5. The sweep and pulverizer as defined in claim 4 wherein the support for said axle includes a top mounting plate and two spaced outer support plates affixed to said top plate and extending down from said top plate, said axle being journaled for rotation in said outer support plates.

6. The sweep and pulverizer as defined in claim 5 wherein the support for said mounting base includes two spaced inner support plates inside said outer support plates, affixed to said top plate and extending down from said top plate and connected at the lower ends of said support bar.

7. The sweep and pulverizer as defined in claim 1 wherein said axle is supported for rotation from below said mounting base.

8. The sweep and pulverizer as defined in claim 1 wherein said axle is supported for rotation from above said mounting base.

9. The sweep and pulverizer as defined in claim 1 wherein said axle is supported for rotation I a plurality of spaced journals rigidly attached to said mounting base, said journals being located adjacent the ends and between the ends of said axle.

10. The sweep and pulverizer as defined in claim 1 wherein said pivot bracket means includes a plurality of pivot brackets at spaced intervals along said axle.

11. The sweep and pulverizer as defined in claim 10 wherein each pivot bracket has a top leg extending rearwardly from said axle and a vertical leg extending down from the rear of said top leg, said blade being affixed to a front edge of said vertical leg to locate said vertical leg in a trailing position relative to said blade.

12. The sweep and pulverizer as defined in claim 11 wherein the said vertical leg has an upper section integral with said top let and a lower section movable relative to said upper section to change the length of said vertical leg, said blade having a leading face and a trailing face, said trailing face being rigidly affixed to a front edge of said lower section.

13. The sweep and pulverizer as set forth in claim 12 wherein said upper section has a hole and said lower section has a vertical slot, a threaded bolt extending through said hole and said slot and a nut threaded on said bolt wherein the tightening of said nut rigidly affixes said lower section to said upper section.

14. The sweep and pulverizer as defined in claim 10 wherein each pivot bracket has a front edge that engages the trailing face of said mounting bar to provide a stop to limit the extent of forward rotation of said axle.

15. The sweep and pulverizer as defined in claim 10 wherein each pivot bracket has a front edge that bears against a trailing face of said blade.

16. The sweep and pulverizer as defined in claim 10 wherein said blade is adjustably mounted to each of said pivot brackets to allow said blade to tilt laterally along the length of said blade.

17. The sweep and pulverizer as defined in claim 10 wherein said blade is detachably secured to each of said pivot brackets.

18. The sweep and pulverizer as defined in claim 10 wherein said blade is vertically, adjustably mounted to each of said pivot brackets.

19. The sweep and pulverizer as defined in claim 1 wherein each blade is rectangular shaped having a flat front face, a flat rear face, a flat top edge, and a flat bottom edge.

20. The sweep and pulverizer as defined in claim 1 wherein said blade biasing means is in the form of a blade biasing device which includes a compression spring connected between said mounting and said pivot bracket means and extending substantially perpendicular to said axle.

21. The sweep and pulverizer as defined in claim 20 wherein said compression spring is detachably secured to said mounting base.

22. The sweep and pulverizer as defined in claim 21 wherein one end of said compression spring is seated on a first spring bracket secured to said mounting base.

23. The sweep and pulverizer as set forth in claim 22, the other end of said compression spring is seated on a second spring bracket attached to a bell and crank bracket portion on one of said pivot brackets.

24. The sweep and pulverizer as defined in claim 22 wherein said first spring support bracket has a rod with a first washer affixed thereto that rear against on end of said spring, said rod having a hole to facilitate pivotally attaching said first spring support bracket to said mounting base.

25. The sweep and pulverizer as defined in claim 23 wherein said second spring support bracket has a tubular body that telescopes over said rod and has a second washer affixed thereto to bear against the other end of said spring to provide guided movement of said first and second washers toward and away from one another, said tubular body having a tab with a hole to facilitate pivotally attaching said second spring support bracket to said pivot bracket.

26. The sweep and pulverizer as set forth in claim 1 wherein the length of said blade is in the range of about 6 inches to 24 inches.

27. The sweep and pulverizer as defined in claim 1 wherein there are a plurality of circumferentially spaced of said blade sweeps at equally spaced intervals.

28. A blade sweep and pulverizer comprising:

a pulverizer including a housing with a floor having a discharge outlet, a grinding bowl in the housing having a race in the top and grinding rollers in the race, a feed chute for delivering material to be ground into said housing and onto said bowl with reject material on the bowl being pushed over the edge of the bowl onto the floor, a power driven spindle rotating the grinding bowl about a vertical axis, and a blade sweep movable with the spindle through an under-bowl area over the floor below the grinding bowl, said blade sweep including a blade, blade mounting means for supporting said blade vertically above said floor in a down position for sweeping and also for supporting said blade for rotation rearward about a substantially horizontal axis above said blade to a raised position to clear reject material on said floor, said blade mounting means including a mounting base adapted to mount to rotate with said spindle about said vertical axis and adapted to extend radially out from said bowl to near an inside wall surface of said housing, said axle being supported for rotation from below said mounting base by an attachment to a skirt on said bowl, an axle extending along and in substantially parallel relation to said mounting base, said axle supported by said mounting base for rotation about a longitudinal axis of said axle and rotate relative to said mounting base, pivot bracket means along said axle, said pivot bracket means being rigidly fastened to said axle to rotate said axle, and blade biasing means supported by said mounting base arranged to urge said blade to said down position and resist movement to said raised position when said blade is impacted by said reject material during the rotation of said blade over said floor about said vertical axis.

29. A blade sweep and pulverizer comprising:

a pulverizer including a housing with a floor having a discharge outlet, a grinding bowl in the housing having a race in the top and grinding rollers in the race, a feed chute for delivering material to be ground into said housing and onto said bowl with reject material on the bowl being pushed over the edge of the bowl onto the floor, a power driven spindle rotating the grinding bowl about a vertical axis, and a blade sweep movable with the spindle through an under-bowl area over the floor below the grinding bowl, said blade sweep including a blade, blade mounting means for supporting said blade vertically above said floor in a down position for sweeping and also for supporting said blade for rotation rearward about a substantially horizontal axis above said blade to a raised position to clear reject material on said floor, said blade mounting means including a mounting base adapted to mount to rotate with said spindle about said vertical axis and adapted to extend radially out from said bowl to near an inside wall surface of said housing, said axle being support for rotation from above said mounting base by a mounting plate attached to the underside of said bowl, an axle extending along and in substantially parallel relation to said mounting base, said axle supported by said mounting base for rotation about a longitudinal axis of said axle and rotate relative to said mounting base, pivot bracket means along said axle, said pivot bracket means being rigidly fastened to said axle to rotate said axle, and blade biasing means supported by said mounting base arranged to urge said blade to said down position and resist movement to said raised position when said blade is impacted by said reject material during the rotation of said blade over said floor about said vertical axis.

30. A blade sweep and pulverizer comprising:

a pulverizer including a housing with a floor having a discharge outlet, a grinding bowl in the housing having a race in the top and grinding rollers in the race, a feed chute for delivering material to be ground into said housing and onto said bowl with reject material on the bowl being pushed over the edge of the bowl onto the floor, a power driven spindle rotating the grinding bowl about a vertical axis, and a blade sweep movable with the spindle through an under-bowl area over the floor below the grinding bowl, said blade sweep including a blade, mounting base adapted to mount to rotate with said spindle about said vertical axis and adapted to extend radially out from said bowl to near an inside wall surface of said housing, said axle being supported for rotation from below said mounting base by an attachment to a skirt on said bowl, an axle extending along and in substantially parallel relation to said mounting base, said axle supported by said mounting base for rotation about a longitudinal axis of said axle and rotate relative to said mounting base, pivot bracket means along said axle, said pivot bracket means being rigidly fastened to said axle to rotate said axle, and blade biasing means supported by said mounting base arranged to urge said blade to said down position and resist movement to said raised position when said blade is impacted by said reject material during the rotation of said blade over said floor about said vertical axis.

31. The sweep and pulverizer as defined in claim 30 wherein said mounting base is mounted to skirt surrounding and attached to said spindle.

32. The sweep and pulverizer as defined in claim 30 wherein said mounting base is mounted to an underside of said grinding bowl.

* * * * *